United States Patent [19]

Lesslie et al.

[11] Patent Number: 5,075,658

[45] Date of Patent: Dec. 24, 1991

[54] MOLDED CASE CIRCUIT BREAKER TRIP-TO-TEST BUTTON AND AUXILIARY SWITCH INTERFACE

[75] Inventors: David J. Lesslie; Dennis J. Doughty, both of Plainville, Conn.

[73] Assignee: General Electric Company, New York, N.Y.

[21] Appl. No.: 553,464

[22] Filed: Jul. 16, 1990

[51] Int. Cl.[5] ..... H01H 75/00

[52] U.S. Cl. ..... 335/14; 335/167

[58] Field of Search ..... 335/9, 13, 14, 22-24, 335/42, 45, 26, 167-174

[56] References Cited

U.S. PATENT DOCUMENTS

| | | | |
|---|---|---|---|
| 3,671,890 | 6/1972 | Klein et al. . | |
| 4,211,907 | 7/1980 | Troebel | 335/42 |
| 4,591,942 | 5/1986 | Willard et al. . | |
| 4,728,914 | 3/1988 | Morris et al. . | |
| 4,740,768 | 4/1988 | Morris et al. | 335/22 |
| 4,754,247 | 6/1988 | Raymont et al. . | |
| 4,788,621 | 11/1988 | Russell et al. . | |
| 4,794,356 | 12/1988 | Yu et al. . | |
| 4,802,052 | 1/1989 | Brant et al. | 335/202 |
| 4,831,221 | 5/1989 | Yu et al. . | |
| 4,864,263 | 9/1989 | Castonguay et al. . | |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An electronic trip molded case circuit breaker includes components that are designed for high speed robotic assembly. A unitary trip-to-test button is down-loaded within the circuit breaker housing for automatic alignment with the circuit breaker operating mechanism during the circuit breaker assembly process. A unitary auxiliary switch interface unit is also down-loaded within the housing for automatic alignment with the operating mechanism during the assembly process.

10 Claims, 6 Drawing Sheets

MOLDED CASE CIRCUIT BREAKER TRIP-TO-TEST BUTTON AND AUXILIARY SWITCH INTERFACE

BACKGROUND OF THE INVENTION

Industrial-rated circuit breakers are currently available having operating components that are designed for automatic assembly to provide cost improvement as well as improved operating efficiency. The precision alignment performed by the automated assembly equipment assembles the operating components within very close operating tolerances. An operating mechanism designed for down-loaded automated assembly is described in U.S. Pat. No. 4,864,263, which Patent is incorporated herein for reference purposes. The operating mechanism assembly includes a pair of operating springs that are overcentered for rapidly driving the movable contact arm and the attached movable contact away from the stationary fixed contact to interrupt the circuit current. The operating mechanism includes a cradle operator which engages a latch assembly to prevent the movable contact arm from being driven to its open position under the urgence of the charged operating springs. The compact latch assembly includes a primary and secondary latch operating within a common support structure.

U.S. Pat. No. 3,671,890 entitled "Manually Operable Molded Case Circuit Breaker With Special Trip Testing Means" and U.S. patent application Ser. No. 486,681 filed Mar. 1, 1990 entitled "Rotatable Trip Test Assembly for Molded Case Circuit Breakers" both describe a trip-to-test button that allows the circuit breaker operating mechanism to be manually articulated for test purposes. In some applications, it is more advantageous to articulate the operating mechanism by linear displacement of the trip-to-test button shaft rather than by rotation.

An auxiliary switch device such as described in U.S. Pat. No. 4,831,221 entitled "Molded Case Circuit Breaker Auxiliary Switch Unit" is used with molded case circuit breakers to provide remote indication of the ON-OFF conditions of the circuit breaker contacts. It would be economically advantageous if a single-sized auxiliary switch could be employed over a wide range of circuit breakers having differing ampere ratings.

Accordingly one purpose of the instant invention is to provide a trip-to-test button that can be installed within an automated circuit breaker assembly process.

A further purpose of the invention is to provide a unit for interfacing between an auxiliary switch accessory unit and the circuit breaker operating mechanism to allow a single auxiliary switch design to be operable over a wide range of circuit breaker ratings.

SUMMARY OF THE INVENTION

The invention comprises a trip-to-test button formed in a unitary plastic assembly with a bifurcated central post that snappingly engages a corresponding aperture formed within a circuit breaker cover to retain the button against the bias of a return spring arranged about the post. An auxiliary switch interface unit is positioned between an auxiliary switch accessory and the circuit breaker operating mechanism to operate the auxiliary switch when the circuit breaker contacts are moved between their ON and OFF positions.

DESCRIPTION OF THE PREFERRED EMBODIMENT

Figure 1:
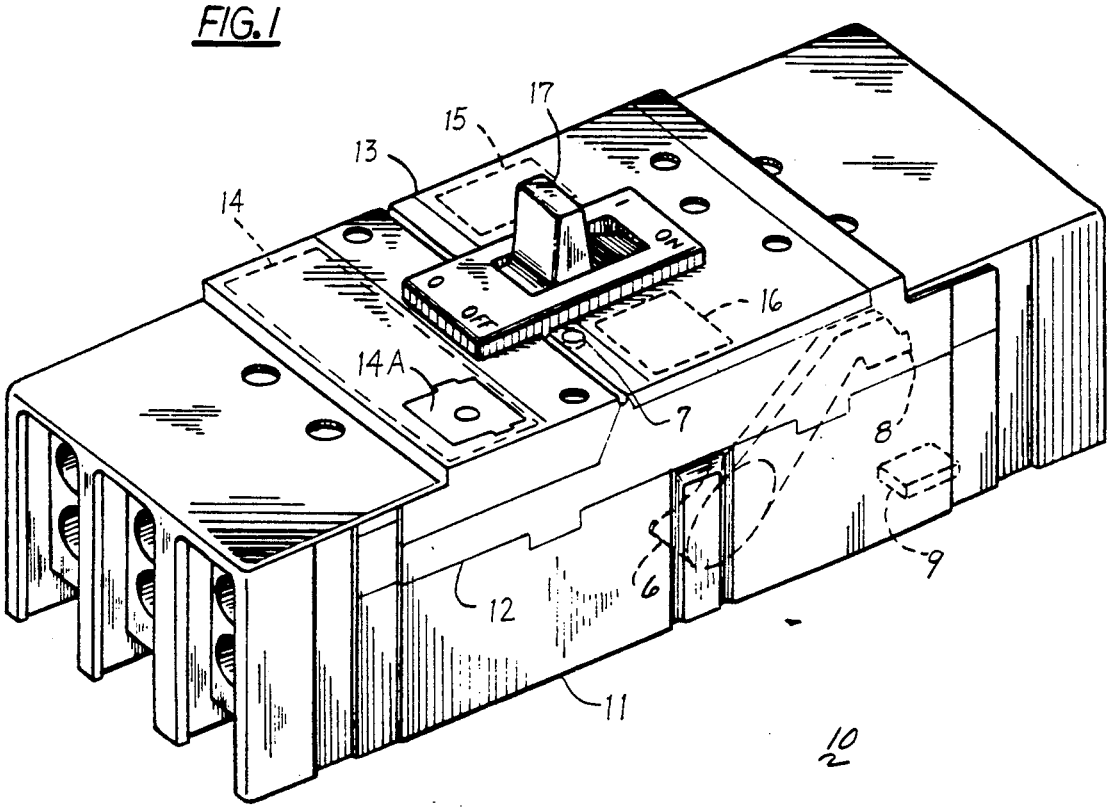
FIG. 1 is a top perspective view of a circuit breaker employing the trip-to-test button and auxiliary switch interface unit in accordance with the invention.

An electronic trip circuit breaker 10 hereafter "circuit breaker", is depicted in FIG. 1 and consists of a molded plastic case 11 to which a molded plastic cover 12 is fixedly secured. An accessory cover 13 is attached to the circuit interrupter cover and provides access to an electronic trip unit 14, an actuator-accessory unit 15 and an optional accessory unit such as the auxiliary switch unit depicted at 16. An operating handle 17 extends through the circuit interrupter cover and provides manual intervention to turn the circuit interrupter contacts 8, 9 between their open and closed positions. A rating plug 14A electrically communicates with the electronic trip unit to set the ampere rating of the circuit breaker. A trip-to-test button 7 is installed within the circuit breaker cover to manually articulate the circuit breaker operating mechanism (not shown) and to separate the circuit breaker contacts by rotation of the operating mechanism crossbar 6.

Figure 2:
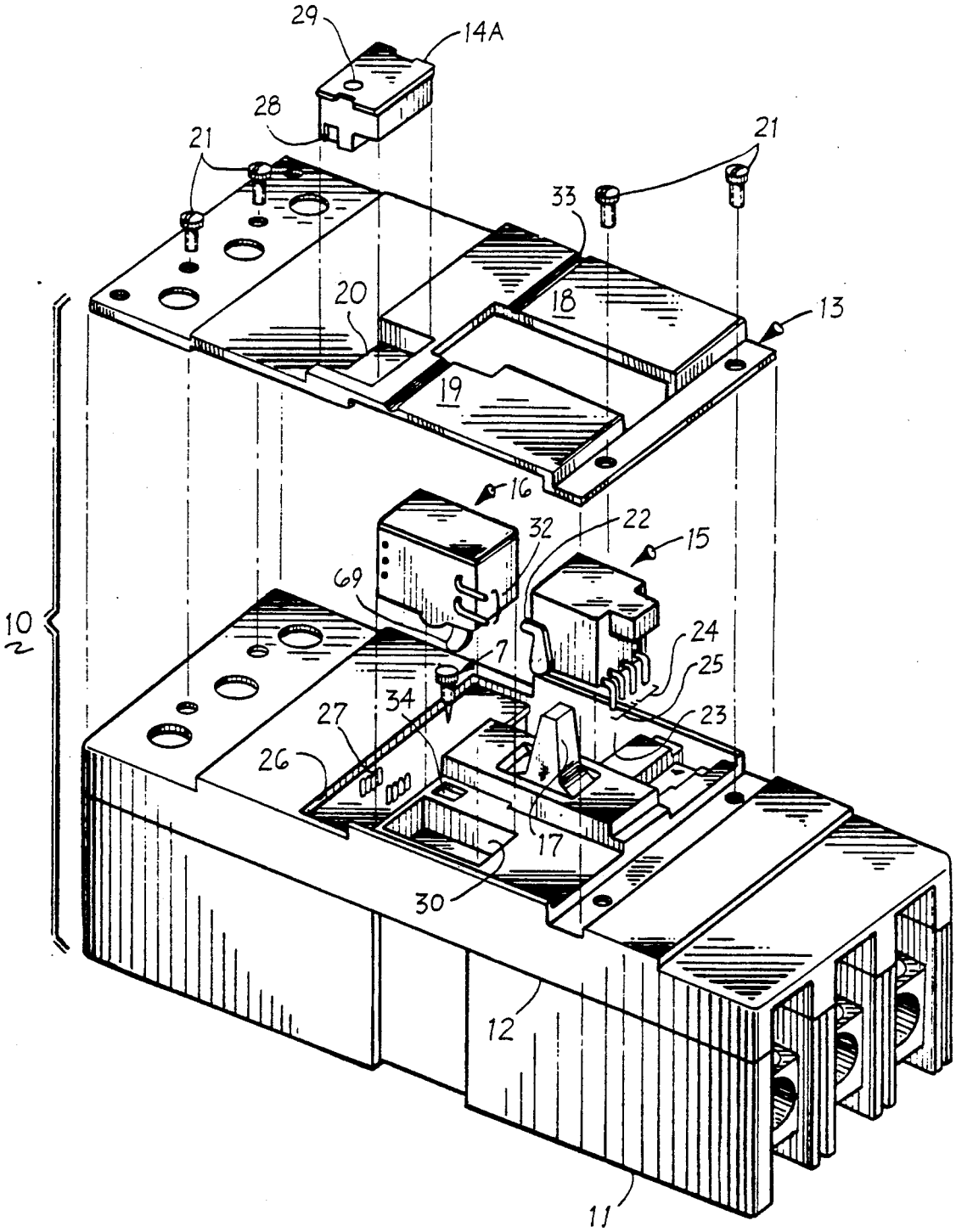
FIG. 2 is a top perspective view of the circuit breaker of FIG. 1 prior to assembly of the accessory cover and accessory components.

A pair of accessory doors 18, 19 are formed in the accessory cover for providing access to the actuator-accessory unit 15 and auxiliary switch 16, shown in the circuit breaker 10 depicted in FIG. 2. The rating plug 14A is fitted within a recess 20 formed in the accessory cover and the accessory cover is fastened to the circuit breaker cover by means of screws 21. Still referring to FIG. 2, the actuator-accessory unit 15 contains a flux shifter coil (not shown) and is fitted with an actuator lever 22 for interrupting the circuit breaker operating mechanism. The actuator-accessory unit 15 is fitted within a recess 23 and connects with the electronic trip unit 14 by means of wire conductors 24 and with an external shunt trip switch by means of wire conductors 25. The electronic trip unit 14 is inserted in the electronic trip unit recess 26 formed in the circuit breaker cover 12 and connects electrically with the rating plug 14A by means of connector pins 27 upstanding on the electronic trip unit and sockets 28 formed in the bottom of the rating plug. The rating plug is described in U.S. Pat. No. 4,728,914 which Patent is incorporated herein for purposes of reference. Access opening 29 formed on the top of the rating plug allows for verifying the trip characteristics of the electronic trip unit. The electronic trip unit electrically connects with a current transformer (not shown) contained within the circuit breaker case 11 and which is described in U.S. Pat. No. 4,591,942 which Patent is incorporated herein for purposes of reference. The circuit breaker includes three poles, with one current transformer supplied within each separate pole. In accordance with the instant invention, the auxiliary switch unit 16 is inserted within the recess 30 formed in the circuit breaker cover and is positioned such that a depending lever 69 interacts with the circuit breaker operating mechanism in a manner to be described below in greater detail. A pair of wire conductors 32 electrically connect to a remote bell or alarm to indicate the closed or open condition of the circuit breaker contacts. In the particular arrangement depicted in FIG. 2, access to the actuator-accessory unit 15 is made by means of accessory door 18 which is integrally-formed within the accessory cover 13 and access to the auxiliary switch 16 made by means of the corresponding accessory door 19. This arrangement differs from those described in U.S. Pat. Nos. 4,794,356 and 4,788,621 which Patents are incorporated herein for purposes of reference. The accessory doors 18, 19 are hingeably attached to the accessory cover 13 by means of a hinge 33 integrally-formed therein. A good description of the accessory cover 13 is found within U.S. Pat. No. 4,754,247 which Patent is incorporated herein for reference purposes. In further accordance with the invention, the trip-to-test button 7 hereafter "test button" is inserted within the recess 34 formed within the circuit breaker cover 12 next to the operating handle 17. The function of the test button is best seen by referring now to FIGS. 3, 4A, 4B.

Figure 3:
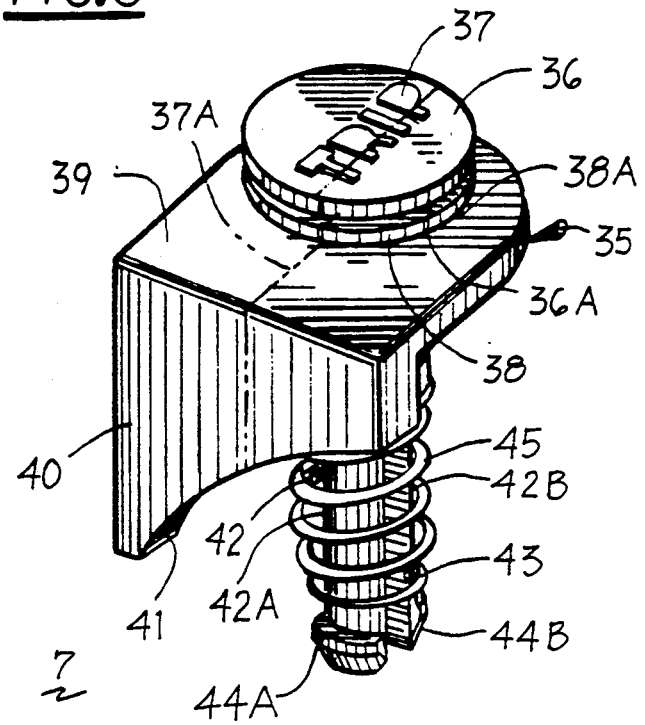
FIG. 3 is an enlarged top perspective view of the trip-to-test button according to the invention.
Figure 4A:
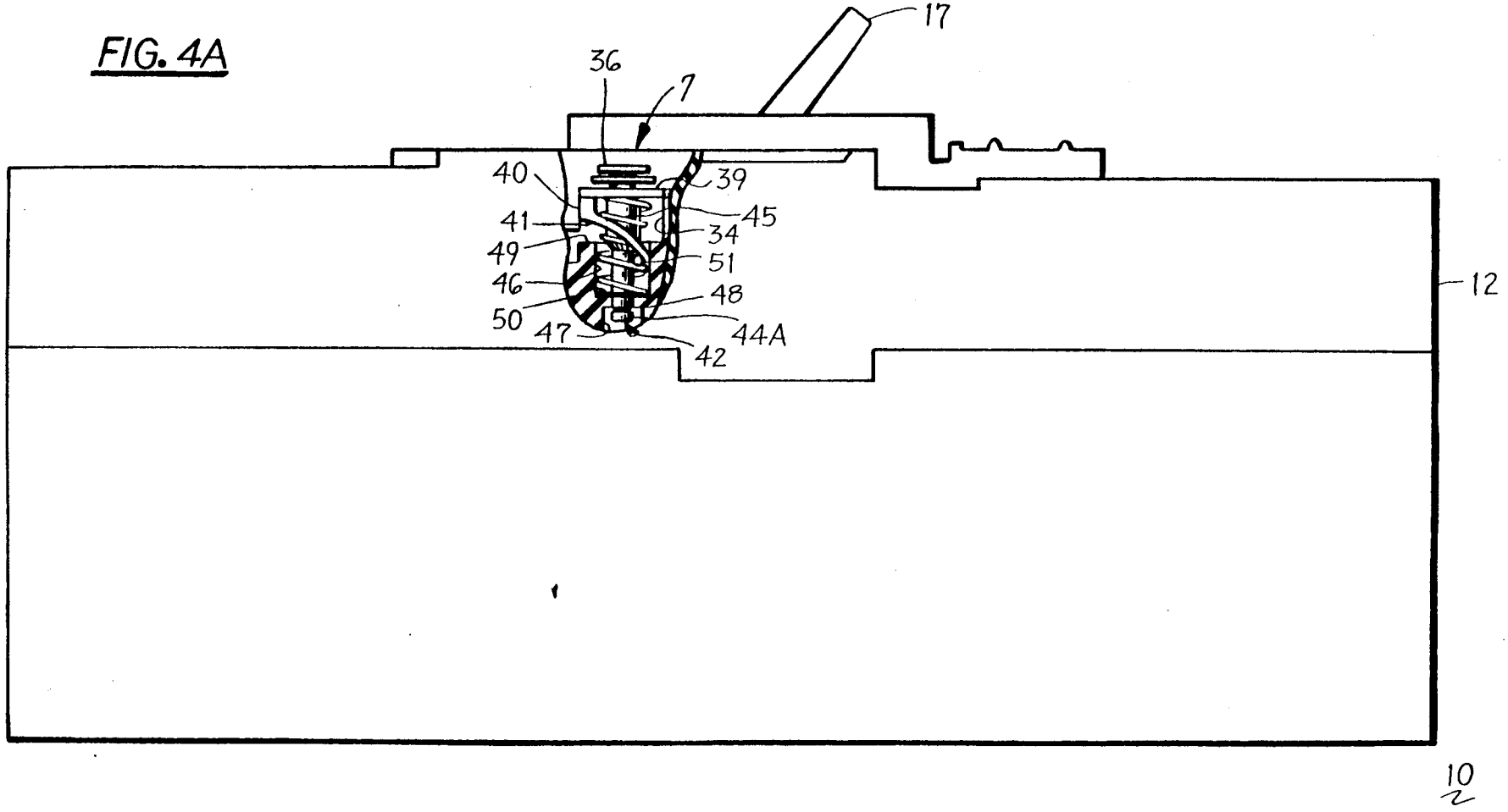
FIG. 4A is an enlarged cutaway side view of the circuit breaker of FIG. 1 depicting the trip-to-test button in a non-operative state.

As shown in FIG. 3, the test button 7 is formed from a thermoplastic composition into a unitary body 35 upon which is positioned a top disc 36 with the trip indicia 37 integrally-formed therein. The plastic mold used to form the body 35 is a two-part mold and is shaped such that the trip indicia 37 extends along the mold parting line as indicated in phantom at 37A. This arrangement eliminates the requirement of supplemental mold equipment and thereby realizes a substantial savings in such mold equipment costs. A middle disc 38 is formed under the top disc and is joined to a semi-circular planar shelf 39. The top disc 36 provides digital access to an operator for driving the test button into direct contact with the circuit breaker operating mechanism trip bar 51 (FIG. 4A). The provision of the top and middle discs 36, 38 increases the oversurface electrical clearance between the operator and the electrified operating mechanism trip bar due to the increased surface distance provided by the intervening slots 36A and 38A defined between the top and middle discs and between the middle disc and the semi-circular shelf 39. The downwardly depending side arm 40 with the cam-shaped radial surface 41 contacts the operating mechanism trip bar and drives the trip bar along the cam-shaped surface to articulate the circuit breaker operating mechanism to rapidly separate the circuit breaker contacts. The bifurcated post 42 depending from the semi-circular shelf 39 positions and retains the test button within the circuit breaker cover by means of the post parts 42A, 42B separated by the elongated slot 43. The provision of the elongated slot allows the separated parts 42A, 42B to become pressed together and resiliently returned to the rest position shown in FIG. 3. A corresponding pair of elongated projections 44A, 44B then trap the test button within the trip-to-test button recess 34 in the manner best seen by referring now to FIGS. 3, 4A, 4B. The recess 34 is formed within the cover 12 of the circuit breaker 10 and defines a large cavity 46 and a subjacent small cavity 47 as indicated. When the test button 7 is inserted within the trip-to-test button recess 34 the compression spring 45 arranged around the bifurcated post stops against the bottom 50 of the large cavity 46 and the bifurcated post 42 extends down through slot 48 to within the small cavity 47 whereupon the angulated projections expand within the small cavity as indicated at 44A thereby preventing removal of the test button from the test button recess. The compression spring 45 around the bifurcated post 42 automatically centers the bifurcated post within the large cavity 46 and the small cavity 47 to allow the bifurcated post to travel concentrically within both the large cavity and small cavity when the top disc 36 is depressed and released. The downwardly depending side arm 40 abuts the operating mechanism trip bar 51 when the circuit breaker contacts are in their closed condition and the operating handle 17 is in the ON position shown in FIG. 4A and stops against the top surface 49 of the large cavity 46 when the top disc 36 is depressed.

Figure 4B:
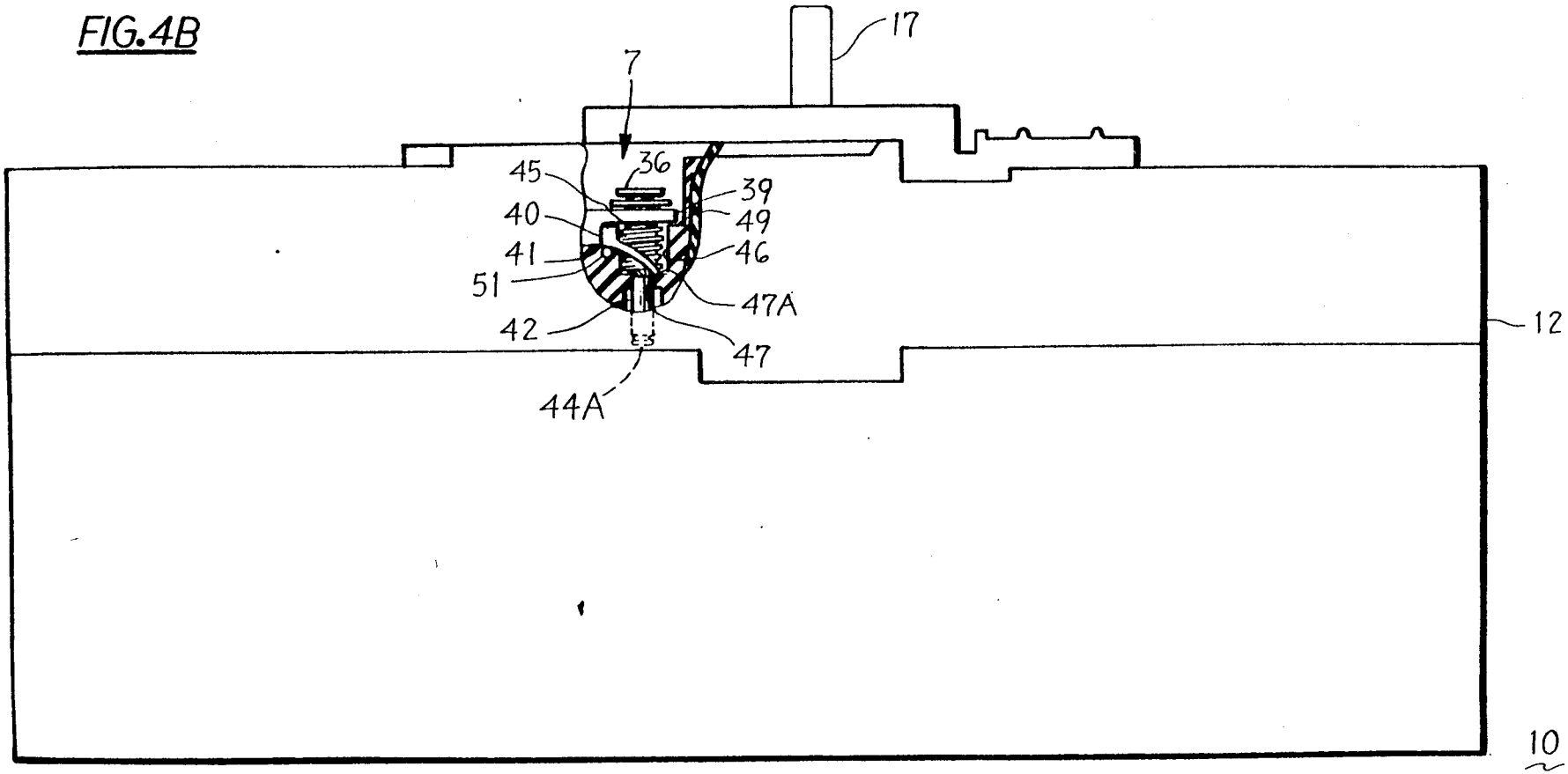
FIG. 4B is an enlarged cutaway side view of the circuit breaker of FIG. 1 depicting the trip-to-test button in an operative state.

Depressing the top disc 36 drives the downwardly depending side arm 40 and cam-shaped radial surface 41 into contact with the trip bar 51 to articulate the circuit breaker operating mechanism and separate the circuit breaker contacts. The operating handle 17 immediately transfers to its "TRIPPED" position as depicted in FIG. 4B. The bifurcated post 42 descends down within the small cavity 47 while the compression spring 45 moves down within the large cavity 46 until the semi-circular shelf 39 stops against the top surface 49 of the large cavity 46. When released, the trip test button and top disc 36 immediately return to the rest position shown earlier in FIG. 4A under the urgence of the charged compression spring 45. The angulated projections as indicated at 44A in FIG. 4A stop against the bottom of the juncture 47A defined between the large cavity 46 and the small cavity 47 and the trip bar rides downwardly along the radial surface 41 of the sidearm 40 to the position shown in FIG. 4A. It is thus seen that the cooperation between the trip-to-test button configuration and the corresponding structure provided within the circuit breaker cover accurately positions the test button, centers it, prevents its removal from the cover as well as preventing its complete dissent to the interior of the circuit breaker enclosure.

Figure 5:
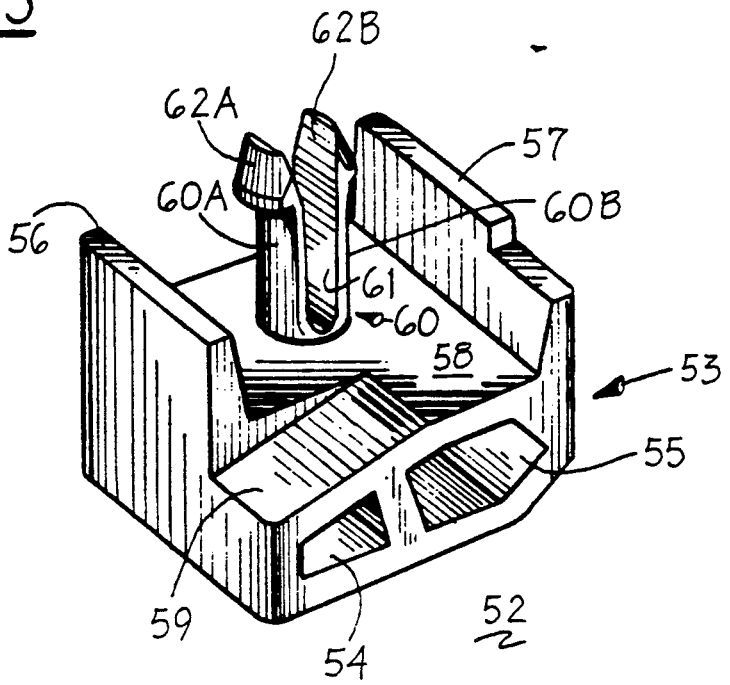
FIG. 5 is an enlarged top perspective view of the auxiliary switch interface unit according to the invention.
Figure 6A:
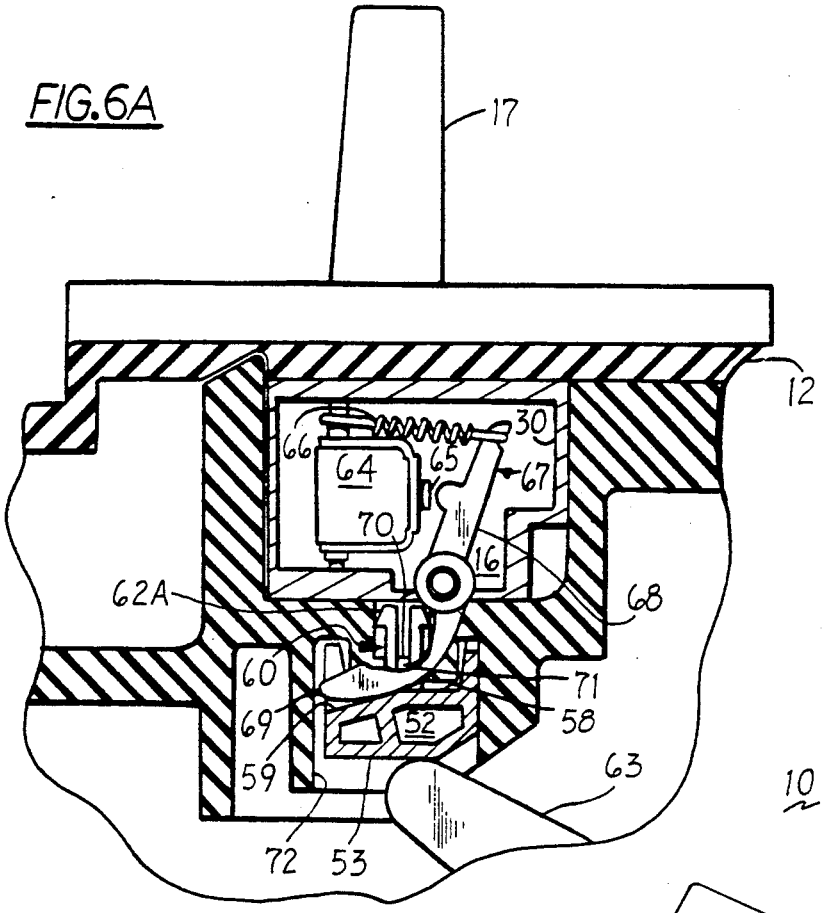
FIG. 6A is an enlarged cutaway side view in partial section of the circuit breaker of FIG. 1 depicting the auxiliary switch in an inactive position.

In order to employ a single auxiliary switch 16 (FIG. 2) over a wide range of circuit breaker ratings, the auxiliary switch interface unit 52 hereafter "interface unit" depicted in FIG. 5 is inserted within the circuit breaker case intermediate the circuit breaker operating mechanism and the auxiliary switch. The interface unit 52 includes a unitary plastic body 53 having material-saving slots 54 and 55 integrally-formed therein to provide lightness and flexibility to the unitary plastic body at a substantial savings of plastic material. A bifurcated post 60 having two parts 60A, 60B separated by an elongated slot 61 stands upright from a platform 58 extending between a pair of rails 56, 57. A pair of angulated projections 62A, 62B are formed at the ends of the post parts to retain the auxiliary switch interface unit within the circuit breaker cover in a manner similar to that described earlier with reference to the trip-to-test button 7 of FIG. 3. The downwardly sloping surface 59 formed at one end of the platform 58 receives the bottom lever 69 of the actuator lever 67 shown within the circuit breaker 10 of FIGS. 6A and 6B. The interface unit 52 is fitted within the adapter recess 72 within the circuit breaker case by inserting the bifurcated post 60 through an aperture 71 formed in the floor 70 of the auxiliary switch recess 30 in the circuit breaker cover 12. The angulated projections one of which is indicated at 62A prevent the interface unit from becoming removed from the adapter recess in a manner similar to that described earlier for the test button 7 shown in FIG. 3. The auxiliary switch 16 as described earlier with reference to U.S. Pat. No. 4,831,221 includes a microswitch 64 mounted within the auxiliary switch recess and containing a switch button 65. The actuator lever 67 includes a top lever 68 which rotates within the auxiliary switch recess 30 along with the bottom lever 69 which rotates within the adapter recess 72. The actuator lever is biased into contact with the switch button 65 by means of an expansion spring 66. The top lever 68 is held away from the switch button 65 by contact between the projection 63 on the operating mechanism crossbar 6 (FIG. 1) and the bottom of the interface unit body 53 in concert with the contact between the bottom lever 69 and the downwardly sloped surface 59 of the platform 58. With the operating handle 17 in the OFF position indicated in FIG. 6A, the interface unit 52 accordingly prevents top lever 68 of the actuator lever 67 from rotating into contact with the switch button 65.

Figure 6B:
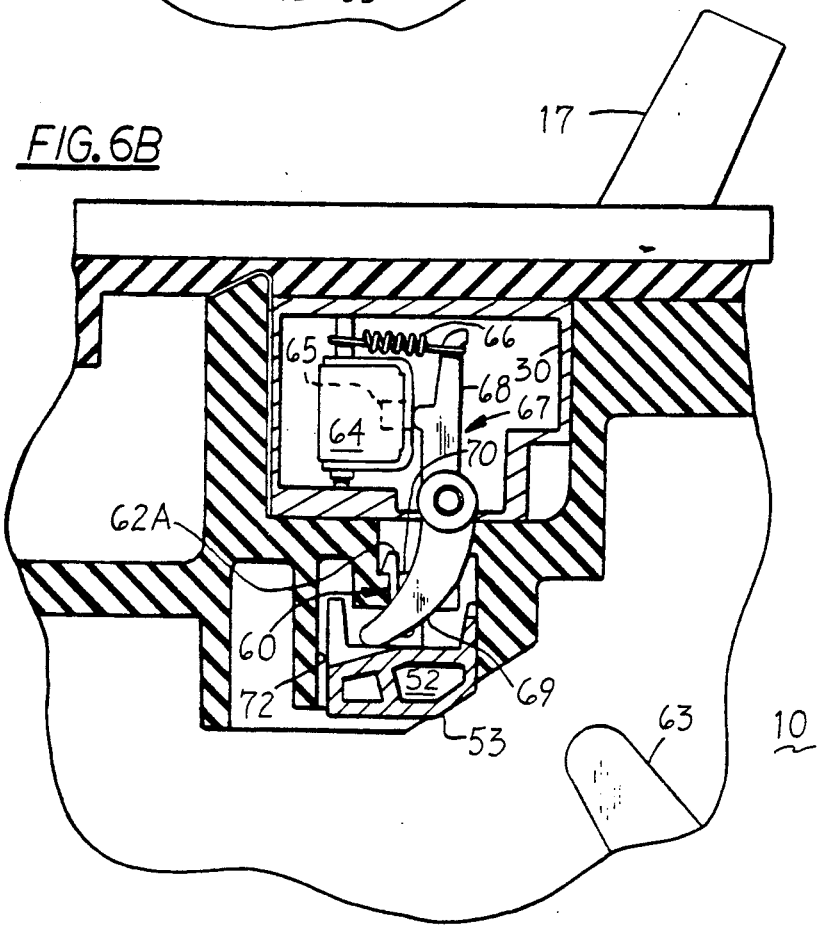
FIG. 6B is an enlarged cutaway side view in partial section of the circuit breaker of FIG. 1 depicting the auxiliary switch in an active position.

With the operating handle 17 on the circuit breaker 10 in FIG. 6B in the "ON" position, it is noted that the projection 63 on the crossbar is away from the bottom of the body 53 of the interface unit 52 and the angulated projections at the end of the bifurcated post 60 rest against the floor 70 of the auxiliary switch recess 30. The actuator lever 67 is rotated under the urgence of the expansion spring 66 in the counterclockwise direction, as viewed in FIG. 6B, to drive the top lever 68 into contact with the switch button 65 thereby activating the microswitch 64 to provide remote indication that the circuit breaker is in its ON condition. The bottom lever 69 has driven the interface unit body 53 downward within the interface unit recess 72 and is prevented from falling out from the recess by means of the angulated projections as described earlier. In the event that the circuit breaker handle is now turned to the OFF position, the projection 63 on the operating mechanism crossbar contacts the interface unit body 53 driving the interface adapter unit 52 back to the OFF condition depicted earlier in FIG. 6A.

Having thus described our invention, what we claim as new and desire to secure by Letters Patent is:

1. A circuit breaker comprising:

a plastic circuit breaker case and a plastic circuit breaker cover;

a pair of contacts within said circuit breaker case arranged for automatic separation by means of an operating mechanism;

an operating handle extending through said circuit breaker cover for manually turning said contacts between open and closed conditions;

a trip unit within said circuit breaker cover determining overcurrent conditions through a protected circuit and activating said operating mechanism to separate said contacts and interrupt circuit current; and a trip button arranged within said circuit breaker cover and extending within said circuit breaker case to contact a part of said operating mechanism and articulate said operating mechanism for test purposes, said trip button comprising a unitary plastic body having a planar shelf supporting a top disc on a top part for providing external access to said trip button and a side arm extending from said shelf and interacting with said operating mechanism part, said trip button including a bifurcated post arranged within a recess in said circuit breaker cover for preventing removal of said trip button from said circuit breaker cover.

2. The circuit breaker of claim 1 wherein said recess includes a first cavity and a second cavity, said first cavity being larger than and arranged over said second cavity.

3. The circuit breaker of claim 2 including a spherical spring arranged around said bifurcated post, said spring centering said bifurcated post within said first and second cavities.

4. The circuit breaker of claim 1 including a camming surface formed on one edge of said sidearm.

5. The circuit breaker of claim 4 wherein said camming surface is radially-shaped.

6. The circuit breaker of claim 3 including a pair of angulated projections formed at one end of said bifurcated post.

7. The circuit breaker of claim 6 wherein said angulated projections extend into and become trapped within said second cavity.

8. The circuit breaker of claim 1 wherein a bottom of said planar shelf stops against a top of said first cavity when said top disc is depressed.

9. A circuit breaker comprising:

a plastic circuit breaker case and a plastic circuit breaker cover;

a pair of contacts within said circuit breaker case arranged for automatic separation by means of an operating mechanism;

an operating handle extending through said circuit breaker cover for manually turning said contacts between open and closed conditions;

a trip unit within said circuit breaker cover determining overcurrent conditions through a protected circuit and activating said operating mechanism to separate said contacts and interrupt circuit current; and a trip button arranged within said circuit breaker cover and extending within said circuit breaker case to contact a part of said operating mechanism and articulate said operating mechanism for test purposes, said trip button comprising a unitary plastic body having a planar shelf supporting a top disc on a top part for providing external access to said trip button and a side arm extending from said shelf and interacting with said operating mechanism part, said trip button including a bifurcated post arranged within a recess in said circuit breaker cover for preventing removal of said trip button from said circuit breaker cover and a second disc subjacent said first disc and separated therefrom by a predetermined distance to thereby increase oversurface electrical clearance between said first disc and said operating mechanism part.

10. The circuit breaker of claim 9 wherein said second disc is separated from said planar shelf by said predetermined distance to further increase said oversurface electrical clearance.

* * * * *